US006241363B1

(12) United States Patent
Lee

(10) Patent No.: US 6,241,363 B1
(45) Date of Patent: Jun. 5, 2001

(54) COLORED LIGHT MIXING DEVICE

(76) Inventor: Ching-Chuan Lee, No. 9, Lane 50, Sec., 3, Muhsin Road, Taipei (TW)

( * ) Notice: Subject to any disclaimer, the term of this patent is extended or adjusted under 35 U.S.C. 154(b) by 0 days.

(21) Appl. No.: 09/501,499

(22) Filed: Feb. 10, 2000

(51) Int. Cl.[7] ..... F21V 9/00
(52) U.S. Cl. ..... 362/231; 362/333
(58) Field of Search ..... 362/230, 231, 362/330, 333, 244

(56) References Cited

U.S. PATENT DOCUMENTS 4,542,449 * 9/1985 Whitehead ..... 362/330
5,097,258 * 3/1992 Iwaki ..... 340/815.67

* cited by examiner

*Primary Examiner*—Sandra O'Shea
*Assistant Examiner*—Hargobind S. Sawhney
(74) *Attorney, Agent, or Firm*—Dougherty & Troxell

(57) ABSTRACT

A colored light mixing device, disclosed having at least one light source set and a color mixing plate. The light source set has three light generating units which generate light of different colors. The color mixing plate is made of transparent material, having a lower surface that faces the at least one light source set with a lower wavelike pattern and an upper surface opposite thereto with an upper wavelike pattern that is oriented differently from the lower wavelike pattern. Being hit by light from the at least one light source set, the lower wavelike pattern acts as a plurality of linear light sources for light of mixed colors inside the color mixing plate being illuminated by light from the lower wavelike pattern, the upper wavelike pattern emits light of uniform intensity and mixed hue.

10 Claims, 4 Drawing Sheets

COLORED LIGHT MIXING DEVICE

BACKGROUND OF THE INVENTION

1. Field of The Invention

The present invention relates to a colored light mixing device, particularly to a colored light mixing device having least one light source set with three light generating units, as selected, generating light rays of three colors, passing through a mixing plate from where light with uniform intensity and variable hue emanates.

2. Description of Related Art

Light sources and lamps have been in use for a long time. With the development of society, lamps have acquired functions besides simple lighting, e.g., decorating, advertising, warning, guiding and entertaining is Nowadays, in all places of daily life many types of light sources are found, like electric bulbs, fluorescent tubes and light emitting diodes, all used for the above-mentioned purposes.

Regular light bulbs and fluorescent tubes, however, emit only yellow or white light. To produce another color a colored shade has to be provided, again delivering light of a single color only. Varying gas fillings of the lamps allow for different colors, but a given lamp still emits only a single color. Mixing colors allows new colors generated, but conventionally there is no way to generate mixed colors of uniform hue and intensity.

SUMMARY OF THE INVENTION

It is therefore the object of the present invention to provide a device for mixing colored lights, generating light with uniform intensity and variable hue.

The present invention can be more fully understood by reference to the following description and accompanying drawings.

BRIEF DESCRIPTION OF THE DRAWINGS

The present invention can be more fully understood by referring to the following description and accompanying drawing, in which.

DETAILED DESCRIPTION OF THE PREFERRED EMBODIMENT

Figure 1:
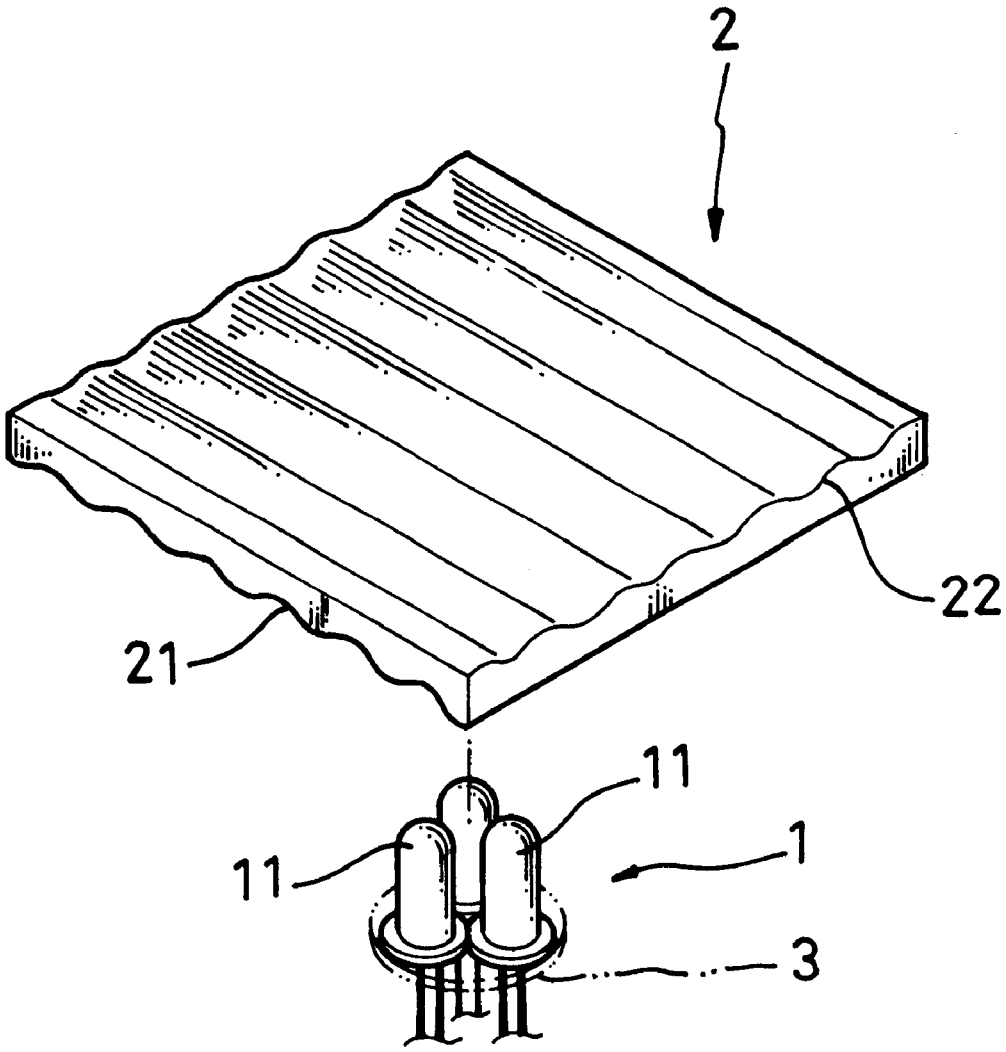
FIG. 1 is a perspective view of the colored light mixing device of the present invention.

As shown in FIG. 1, the colored light mixing device of the present invention mainly comprises: a light source set 1 and a color mixing plate 2.

The light source set 1 has three light generating units 11, which generate light of different hues. The three light generating units 11 are combined in a single body to have equal lighting effects. Preferably, the three light generating units 11 generate the hues red, green and blue. The light source set 1 is mounted on a circuit board 3, controlling the three light generating units 11 to emit light individually, in pairs, or all together in turns. Light emitted by the three light generating units 11 passes through the color mixing plate 2 (in detail explained below), then emanates from there as light of the colors red, green, blue, cyan, magenta, yellow, or white. Preferably, the three light generating units 11 are light emitting diodes (LED), but are not limited thereto. Any light sources emitting light of various hues are suitable.

Figure 2:
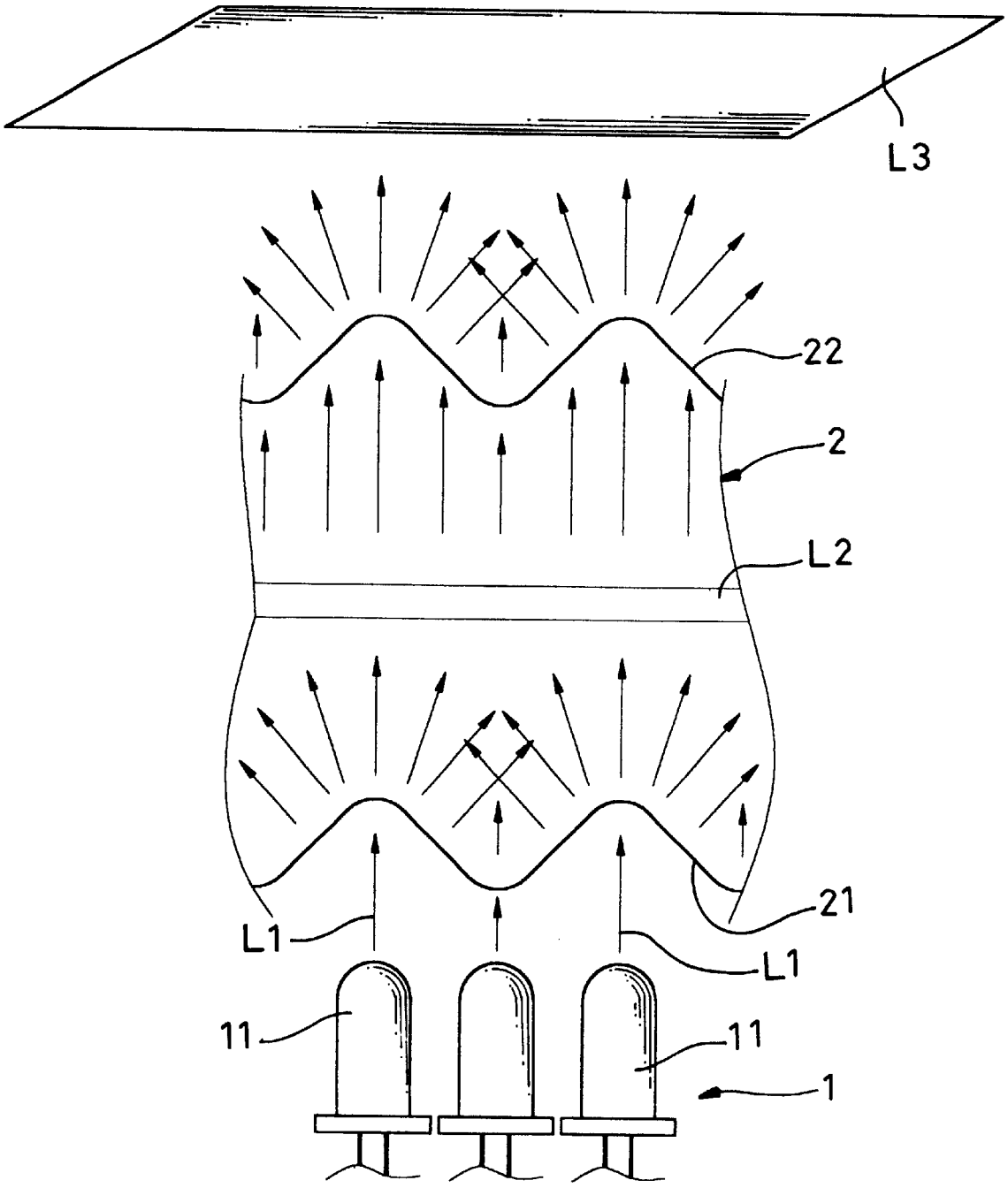
FIG. 2 is a schematic illustration of the light emitting principle of the present invention.

The color mixing plate 2 is a transparent plate with a lower surface, facing the light source set 1, and an upper surface opposite thereto. The lower and upper surfaces are formed as a lower wavelike pattern 21 and an upper wavelike pattern 22, both of which are arrangements of parallel waves. The lower and upper wavelike patterns 21, 22 are oriented in different directions. As shown in FIG. 2, each of the three light generating units 11 of the light source set 1 forms a point-like light source L1. Light therefrom, falls on the lower wavelike pattern 21 of the color mixing plate 2. The lower wavelike pattern 21 acts as a plurality of light linear light sources L2 generating mixed light inside the color mixing plate 2. After passing through the upper wavelike pattern 22, light emanates from the color mixing plate 2, which acts as an area-like light source L3. From there, light with uniform intensity and mixed hue is generated. The color mixing plate 2 is preferably made of transparent plastics or glass.

The circuit board 3 controls the three light generating units 11 to emit light in turn or together. By controlling currents through the three light generating units 11, colored light of various intensities is generated. Thus not only the object of varying hues is achieved, but also adjustment of light incident on the color mixing plate 2, emanating therefrom as uniform light.

Figure 3:
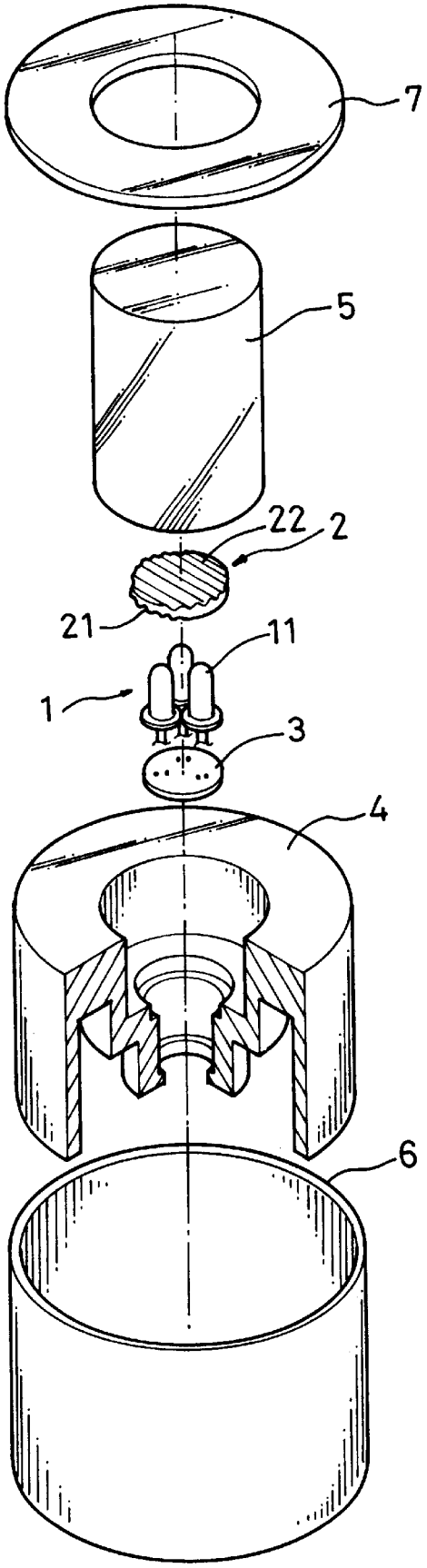
FIG. 3 is an exploded perspective view of the present invention in an embodiment as a decorative lamp body.
Figure 4:
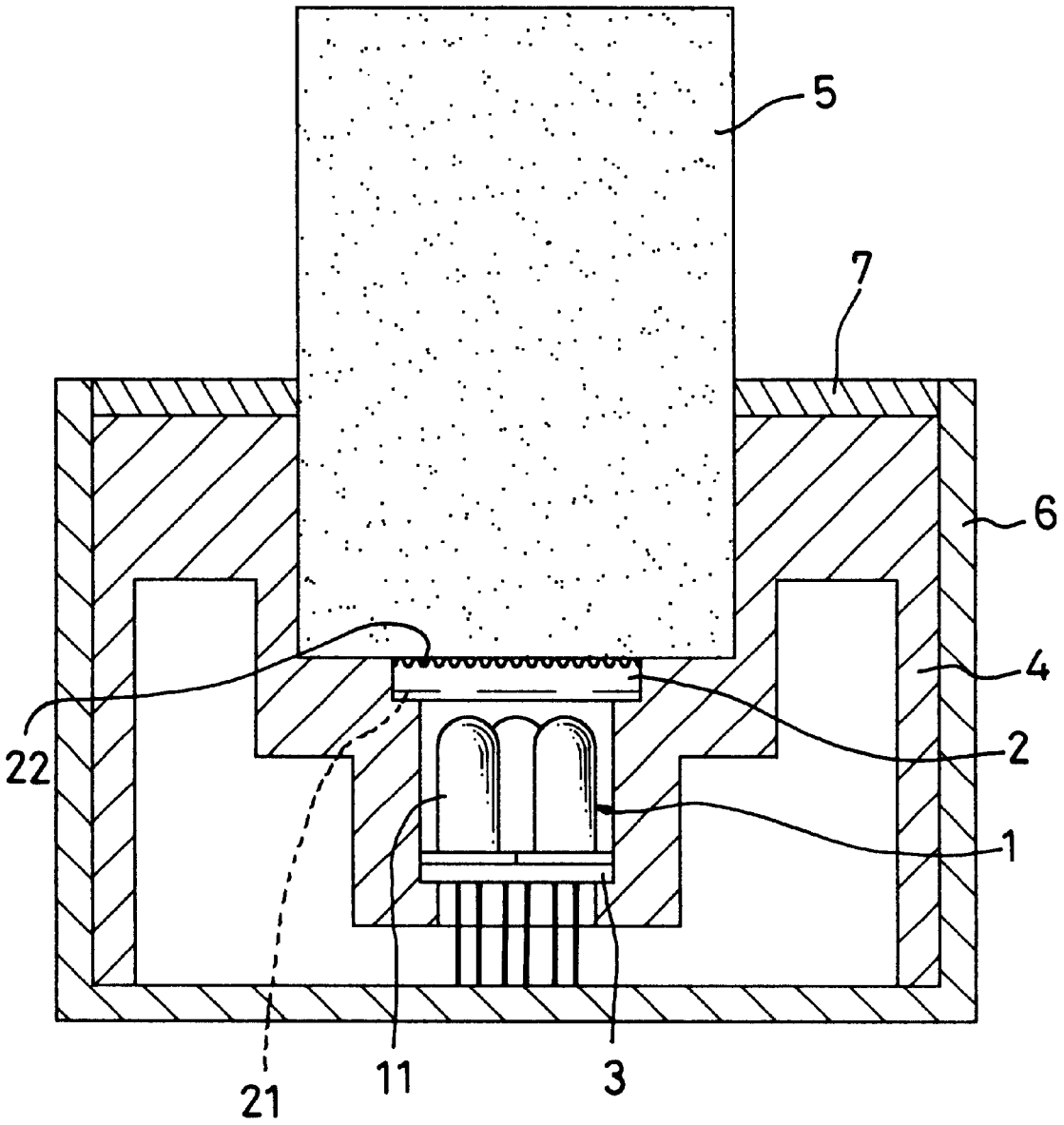
FIG. 4 is a sectional view of the present invention in the embodiment of FIG. 3.

Referring to FIGS. 3 and 4, the present invention in an embodiment is a decorative lamp, which comprises a base 4, a transparent decorative object 5, a casing 6, and a cover 7. The base 4 accommodates and supports the circuit board 3, the light source set 1, the color mixing plate 2, and the transparent decorative object 5. The casing 6 surrounds the base 4. The cover 7 is not transparent and is set on the base 4, tightly connected with the casing 6. With the light source set 1 operating, the three light generating units 11 in turn emit light individually, in pairs, or all together. Light generated by the light source set 1 passes through the lower wavelike pattern 21, acting as a plurality of light linear light sources. After passing through the upper wavelike pattern 22, light emanates therefrom as from an area-like light source and enters the transparent decorative object 5. Thus the transparent decorative object 5 is illuminated with changing colors in a temporary order controlled by the circuit board 3. At the same time, the transparent decorative object 5 is uniformly illuminated, presenting a beautiful view.

The present invention is usable for decorating as well as warning, advertising and guiding purposes.

While the invention has been described with reference to preferred embodiment thereof, it is to be understood that modifications or variations may be easily made without departing from the spirit of this invention, which is defined by the appended claims.

What the invention claimed is:

1. A colored light mixing device, comprising:

at least one light source set, having three light generating units which generate light of different colors; and a color mixing plate, made of transparent material, having a lower surface that faces said at least one light source set with a lower wavelike pattern and an upper surface opposite thereto with an upper wavelike pattern that is oriented differently from said lower wavelike pattern;

wherein said lower wavelike pattern, when illuminated by light from said at least one light source set, acts as a plurality of linear light sources for light of mixed colors inside said color mixing plate, and said upper wavelike pattern, when illuminated by light from said lower wavelike pattern, emits light of uniform intensity and mixed hue.

2. A colored light mixing device according to claim 1, wherein said three light generating units are combined in a single body.

3. A colored light mixing device according to claim 2, wherein said single body is mounted on a circuit board and controlled thereby, so that said three light generating units in said single body in turn emit light individually, in pairs, or all together and light of changing mixed colors emanates from said upper surface of said color mixing plate.

4. A colored light mixing device according to claim 2, wherein said three light generating units in said single body emit red, green and blue light, respectively.

5. A colored light mixing device according to claim 2, wherein said three light generating units in said single body are light emitting diodes (LED) of high intensities.

6. A colored light mixing device according to claim 1, wherein said at least one light source set is mounted on a circuit board and controlled thereby so that said three light generating units in turn emit light individually, in pairs, or all together and light of changing mixed colors emanates from said upper surface of said color mixing plate.

7. A colored light mixing device according to claim 1, wherein said three light generating units emit red, green and blue light, respectively.

8. A colored light mixing device according to claim 1, wherein said three light generating units are light emitting diodes (LED) of high intensities.

9. A colored light mixing device according to claim 1, wherein said lower and upper wavelike pattern each are arrangements of parallel rows.

10. A colored light mixing device according to claim 1, wherein said color mixing plate is made of transparent plastics or glass.

* * * * *